US009579559B2

(12) United States Patent
Borer

(10) Patent No.: US 9,579,559 B2
(45) Date of Patent: Feb. 28, 2017

(54) RACING GAME

(76) Inventor: Stephen G. Borer, Tiffin, OH (US)

( * ) Notice: Subject to any disclaimer, the term of this patent is extended or adjusted under 35 U.S.C. 154(b) by 636 days.

(21) Appl. No.: 13/589,488

(22) Filed: Aug. 20, 2012

(65) Prior Publication Data

US 2013/0043652 A1 Feb. 21, 2013

Related U.S. Application Data

(60) Provisional application No. 61/525,434, filed on Aug. 19, 2011.

(51) Int. Cl.
*A63F 3/00* (2006.01)

(52) U.S. Cl.
CPC ..... *A63F 3/00082* (2013.01)

(58) Field of Classification Search
CPC ..... A63F 3/00082; A63F 3/00006
USPC ..... 273/246, 248, 253
See application file for complete search history.

(56) References Cited

U.S. PATENT DOCUMENTS

| | | | |
|---|---|---|---|
| 3,044,779 | A | 7/1962 | Hvizdash |
| 3,231,279 | A | 1/1966 | Howarth et al. |
| 3,462,152 | A | 8/1969 | Royston |
| 3,738,659 | A | 6/1973 | Partridge |
| 3,899,177 | A | 8/1975 | Sells |
| 4,042,245 | A | 8/1977 | Zarour |
| 4,264,076 | A | 4/1981 | Duncan |
| 4,357,017 | A | 11/1982 | Schneider et al. |
| 4,550,917 | A | 11/1985 | Ferris et al. |
| 4,624,463 | A | 11/1986 | Glennon |
| 4,890,842 | A | 1/1990 | Plange |
| 5,092,605 | A | 3/1992 | Hoffman |
| 5,114,151 | A | 5/1992 | Bergerstock |
| 5,114,152 | A | 5/1992 | Rouse et al. |
| 5,139,267 | A | 8/1992 | Trevisan |
| 5,308,078 | A | 5/1994 | Hatter |
| 5,322,293 | A | 6/1994 | Goyette |
| D350,160 | S | 8/1994 | Dunnavan et al. |
| D350,991 | S | 9/1994 | Goyette |
| 5,350,178 | A | 9/1994 | Hollar |
| 5,551,698 | A | 9/1996 | Lyon |
| 5,749,582 | A | 5/1998 | Fritz et al. |
| 5,934,673 | A | 8/1999 | Telarico et al. |
| 6,095,522 | A | 8/2000 | Spell et al. |
| 6,213,466 | B1 | 4/2001 | Rosen |
| 6,347,813 | B1 | 2/2002 | Star et al. |
| 6,464,223 | B2 | 10/2002 | Rutter |
| 6,471,209 | B1 | 10/2002 | Barshinger |
| 6,764,076 | B2 | 7/2004 | Merritt |
| 6,834,856 | B2 | 12/2004 | Wilson |
| 6,979,000 | B1 | 12/2005 | Vahala |
| 7,261,296 | B1 | 8/2007 | Duncan |
| 2010/0312625 | A1 | 12/2010 | Miller et al. |
| 2011/0018200 | A1 | 1/2011 | Facchini |

*Primary Examiner* — Vishu Mendiratta
(74) *Attorney, Agent, or Firm* — Ward Law Office LLC; Jacob M. Ward

(57) ABSTRACT

A racing game and a method for playing the game. The method includes providing the racing game, generating the at least two random numbers, wherein an at least one player uses the at least two random number generators to generate the at least two random numbers, and advancing the at least one game piece representing the at least one player that corresponds to the at least two random numbers generated. One of the random number generators is used to determine lane choice for at least one player, along which the at least one game piece is advanced during game play.

5 Claims, 2 Drawing Sheets

RACING GAME

CROSS-REFERENCE TO RELATED APPLICATIONS

Figure 1:
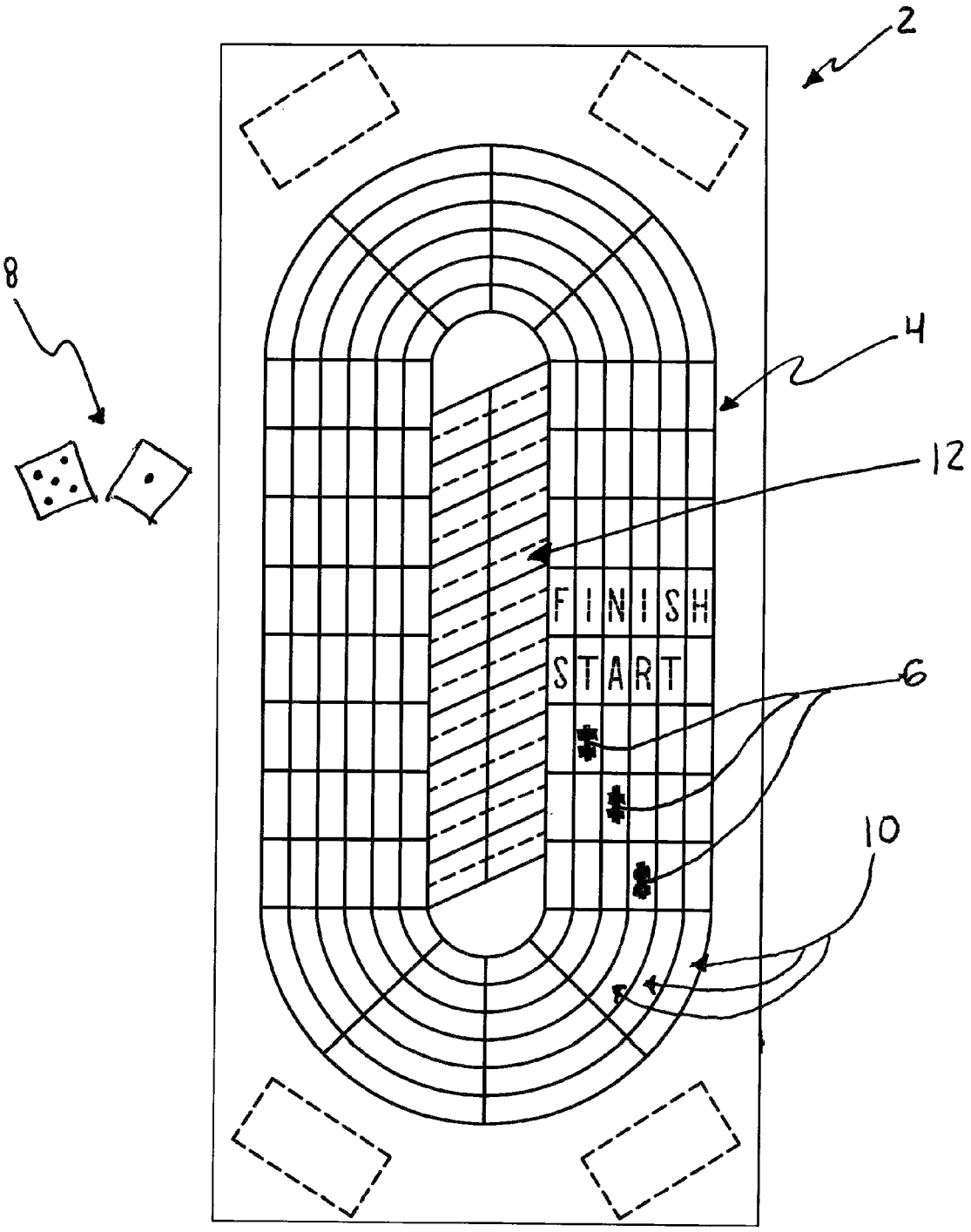

This application claims the benefit of U.S. Provisional Application No. 61/525,434, filed on Aug. 19, 2011. The entire disclosure of the above application is hereby incorporated herein by reference.

FIELD OF THE INVENTION

The present disclosure relates to a game, and more particularly to an apparatus and a method for playing a racing game.

BACKGROUND OF THE INVENTION

Board games are enjoyed by both children and adults of all ages. Racing games are particularly well-liked. Many versions of racing games exist. As nonlimiting examples, U.S. Pat. Nos. 6,834,856, 5,092,605 and 5,749,582 each disclose known racing games including racing lanes and toy cars that advance in the lanes. The entire disclosures of each of the above-mentioned patents are hereby incorporated herein by reference.

The known racing games are not versatile. For example, most exist in only one form, making it difficult for players to participate in the game under variable circumstances and in various locations. Additionally, most racing games are geared toward either children or adults, and cannot be altered to appeal to both children and adults in their various forms, using alternative rules and game add-ons.

There is a need for a versatile racing game appropriate for adults and children of all ages. Desirably, the racing game may be played in multiple locations and with various materials.

SUMMARY OF THE INVENTION

In concordance with the instant disclosure, a versatile racing game appropriate for adults and children of all ages, and which can be played in multiple locations and with various materials, is surprisingly discovered.

In one embodiment, a racing game includes a game surface having a race track with designated spaces and a pit area, and at least one game piece representing at least one player and capable of advancing one or more spaces around the race track. The racing game further includes at least two random number generators.

In another embodiment, the game surface is one of a floor mat, a table cloth, a place mat, a magnetic white board, a yard, and a board.

In a further embodiment, a method for playing a racing game includes a first step of providing a game surface having a race track with designated spaces and a pit area. At least one game piece representing at least one player and capable of advancing one or more spaces around the race track is also provided. At least two random number generators for generating at least two random numbers are also provided. Second, a lane is chosen for the at least one player using one of the random number generators. Third, the at least two random numbers are generated, wherein a first player uses the at least two random number generators to generate the at least two random numbers. Lastly, the at least one game piece representing the at least one player that corresponds to the at least two random numbers generated is advanced around the race track a number of space corresponding to the two random numbers generated, in the lane chosen for the at least one player.

Multiple Versions of the Ultimate Race Game as Follows:

Table Top—Roll Up/Paper (Restaurant)/Pool Table (Custom)/Track Can Be Sold Separately, No Accessories Or With Optional Upgrades.

Miniature Scale—Roll Up/Note Pad (Portable).

Race Leagues For All Age Groups Or A Combination.

White Board With Magnetic Cars—Car Portable/Folding Capabilities/17"×28" Open.

Home Yard Game—Chalk Line In Yard Or Marking Paint/Car Bodies Or Team T-Shirts/Large Inflatable Dice Or Large Wooden Dice.

Casino Style—Craps Table Size.

Outdoor Track With Car Girls With Team Body Wear Or Your Partner As Your Race Car/Small Arena With Car Girls With Team Body Wear Or Your Partner As Your Race Car/Large Inflatable Dice Or Large Wooden Dice.

Accessories Required as Follows:

Cars And Or Your Choice Of Personal Vehicle Or Any Game Piece That Fits Your Lane.

Dice—2 Per Person (12 Total).

Paper Money—For Scoring Purposes.

Clear Plastic Tube Holder For Roll Up Version.

Signs—Optional In Upgrade.

Grand Stands—Optional In Upgrade.

Flag Box—Optional Upgrade.

Miniature Champagne Or Milk Bottles—Optional Upgrade.

Company Truck Haulers & Motor Homes—Optional In Field Upgrade.

Track Sponsors—Optional Advertisement Boards.

Crayons—Restaurant Version/Optional Advertisement.

Rules are as Follows:

Role Single Die To Determine Lane Choice.

If Lane Is Chosen That You Roll Pass To Next Player Without A Lane.

Continue Until Lanes Are All Chosen.

Lane 1 Rolls First—Then Continue In A Clockwise Or Counter Clockwise Manner Until All Lanes Roll.

Each Player Shall Have Their Own Dice If Possible—Helps Speed Of The Game.

After The Roll Of The Dice The (2) Numbers That Are Showing On The Dice Move The Vehicle In Those Corresponding Lanes (1) Space.

Continue Rolling Till A Vehicle Crosses The Finish Line.

Rolling Of Doubles (Same Number) On The Dice Results In A Movement Of (4) Spaces.

All Players Must Agree On How Much Paper Money Will Be Wagered Per Car And How Many Laps Will Be Raced Before The Flag Drops.

You Will Need (6) Individual Players Or Teams Of (1) Or More Car Owners.

If (6) Players Are Not Available You May Buy More Than (1) Car.

Ghost Cars Can Be Ran In The Absence Of Enough Players Which Needs To Be Agreed Upon Before The Flag Drops.

Paint Scraping And Bump Drafting Are Advised.

To Knock The Mojo Out Of A Hot Car We Recommend Throwing Your Dice At The Car In The Lead During Your Roll.

This Can Backfire By Making The Car Hotter Or Cause The Team Owner To Want To Fight You—Caution/Danger.

For A Fast Paced Game All Players Can Roll At Once With Their Individual Dice At The Same Time.

On Pool Table Versions Use Of The Bumpers Is Recommended.

Leagues Can Be Established To All Team Owners Agreed Upon Rules Before The Flag Drops.

Restaurant Version Cars Will Be Drawn In Crayons After Each Movement In Their New Location Until Crossing The Finish Line/(1) Pair Of Dice Need To Be Included & Crayons.

All Rules & Wagers Need To Be Agreed Upon Before The Flag Drops!

After The Flag Drops It's On!

DRAWINGS

The above, as well as other advantages of the present disclosure, will become readily apparent to those skilled in the art from the following detailed description, particularly when considered in the light of the drawings described hereafter.

Figure 2:
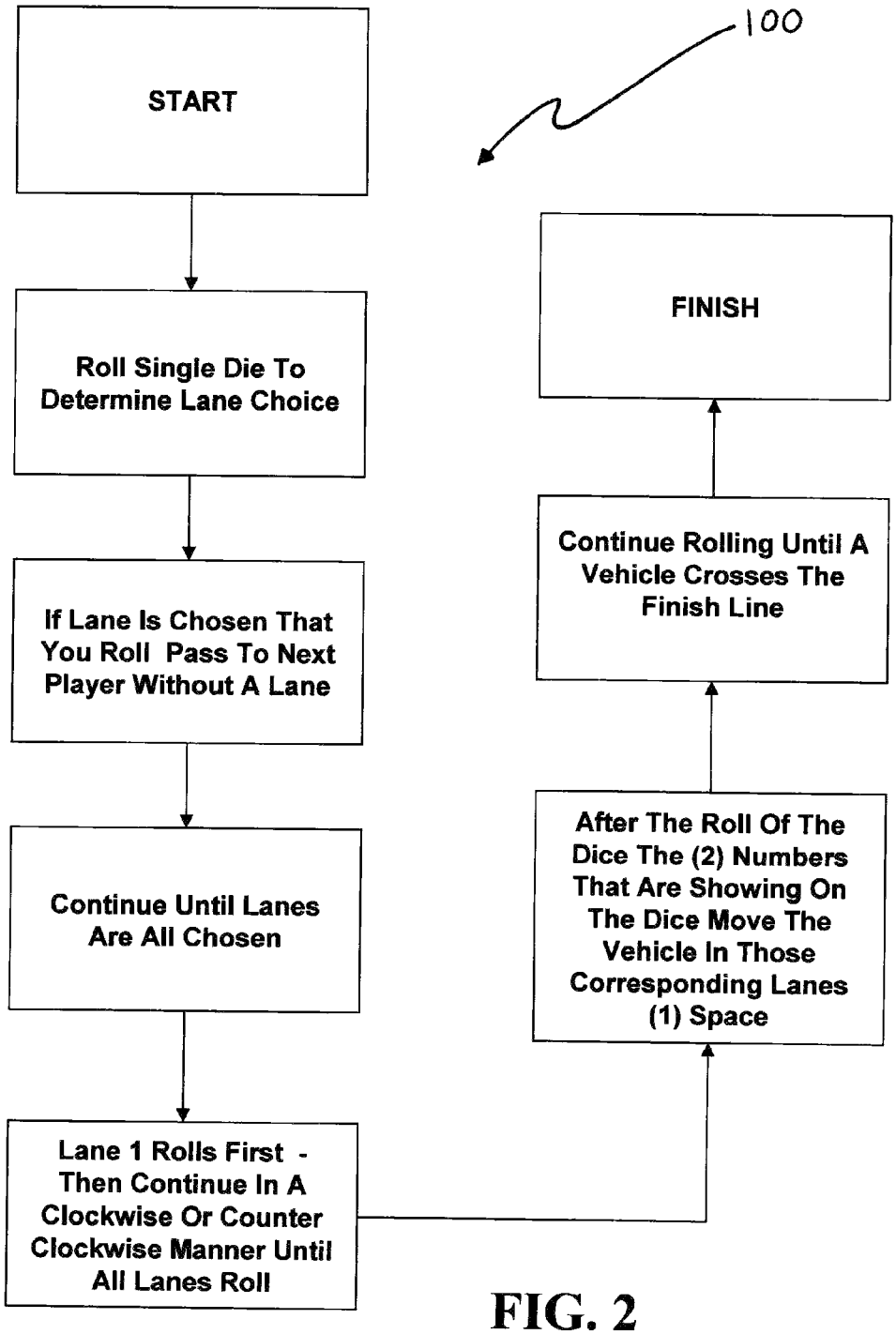

FIG. 1 shows a top plan view of a racing game according to one embodiment of the present disclosure; and FIG. 2 is a flow diagram illustrating an exemplary method for playing the racing game depicted in FIG. 1.

DETAILED DESCRIPTION OF THE INVENTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

As shown in FIGS. 1-2, the invention includes a racing game 2 having a race track 4, game pieces 6, and at least two random number generators 8. The racing game 2 can be in the form of a roll-up floor mat (not shown), a table cloth (not shown), a place mat (not shown), a magnetic or non-magnetic white board (not shown), a large scale yard game (not shown), a traditional board game (not shown), a custom made racing table (not shown), a custom made casino-style table (not shown), and a travel size magnetic game (not shown). A skilled artisan understands that other formats for the racing game 2, including electronic or computer-based formats, may also be used within the scope of the disclosure.

The race track 4 can include any number of lanes 10. The lanes 10 can be numbered or represented in any way that clearly designates each lane 10 differently. The number of players or teams should not exceed the number of lanes 10 on the race track 4. The race track 4 surrounds a pit area 12, where unused game pieces 6 may be placed. The racing game 2 can include additional slogans, symbols, logos, advertisements and sponsors, pit boxes, and seating areas (not shown), as desired.

The game pieces 6, in one exemplary embodiment, are toy cars. However, any item capable of advancing around the race track 4 may be used. For example, the game pieces 6 can be the actual players, magnets, wagering chips, crayon marks, or any other suitable item. There can be any number of game pieces 6 greater than one. However, the number of game pieces 6 must be equal to or greater than the number of players or teams participating.

The at least two random number generators 8 are typically dice, but can be any item capable of generating two random numbers or symbols that correspond to the lanes 10 on the race track 4 per each participant's turn. The random number generators 8 can be electronic number generators. The random number generators 8 must be capable of producing the different numbers or symbols representing each lane 10 in use while the racing game 2 is played. Each player can share the same number generators 8 or each player can have their own. The random number generators 8 can be one random number generator capable of producing to random numbers.

Additional accessories may include additional toy cars, gambling chips for making wagers, a device for keeping score, grand stands, additional pit accessories, and other items that replicate those items found at a conventional race track.

The present disclosure includes a method for playing the racing game 2. An exemplary method 100 for playing the racing game 2 is depicted in FIG. 2.

In a particular embodiment, a first player, for example, chosen at random, rolls a single die to determine lane choice. The number generated by the die corresponds with the lane assigned to the first player rolling the die. For example, if the die displays the number "2", the first player with be assigned to a Lane 2. The die is then passed from the first player to each of the other players, and each of the other players rolls the die to determine his or her assigned lane. If a player rolls the die and the die generates a number corresponding to a lane that has already been assigned, that player must pass the die to a next player who has not already been assigned a lane, and then wait to roll the die again, in turn. This passing of the die continues until all players are assigned a lane. If, for example, there are six players participating, there will be a Player 1 in Lane 1, Player 2 in Lane 2, Player 3 in Lane 3, Player 4 in Lane 4, Player 5 in Lane 5, and Player 6 in Lane 6.

Once all the players have their lane assignments, the game requires at least two random number generators 8 for the remainder of the game. For example, where the random number generators are dice, Player 1 rolls the dice first. The numbers generated by the dice indicate which players can advance their game piece forward one space. For example, if Player 1 rolls a "4" and a "6", then the players in Lanes 4 and 6, Player 4 and Player 6, i.e., advance their game piece one space. Player 1 then passes the die in a clockwise or counterclockwise direction until each player has rolled the dice. This continues until a first game piece passes the finish line or until each game piece passes the finish line. The first player to cross the finish line wins. If a player rolls doubles (the dice display the same number), the player in the lane corresponding to the number displayed on both dice advances their game piece any number of spaces greater than two. For example, if Player 1 rolls the dice and both dice display the number "5", Player 5 advances 3 places. The number of spaces that a player can advance if doubles are rolled should be determined prior to the start of the game.

To increase the speed of the game, each player can have their own set of dice. The players can all roll at once or can quickly roll one after the other. Any number of dice can be used for each player's turn. For example, if three dice are used, and the dice generate the numbers 1, 2, and 3, then Players 1, 2, and 3 each advance their game piece one space on the race track.

Prior to the start of the game, the players may determine how many laps around the race track are required prior to crossing the finish line. One or more laps can be required. For longer races, additional laps around the race track will be required.

Lanes can be assigned to individual players or to a team of players. Leagues can be formed such that numerous games can be played over a definite or indefinite time span, and the number of wins can be kept track of over that time span to determine a league winner.

Players can also decide prior to the start of the game whether wagers can be made on the game pieces in play. For example, players can use gambling chips to make wagers of money or other items of material value on a particular car crossing the finish line first. Wagers can also be made based on other uncertain outcomes as well, such as which car will cross the finish line last. Multiple wagers can be made on multiple cars. In a gambling environment, ghost cars (cars not assigned to a particular player) can advance around the track to fill in lanes where players are not assigned. The wagers and the rules relating to the wagers should be clearly identified prior to the start of the game.

Advantageously, the various forms in which the racing game 2 can be produced allow for the racing game 2 to be played virtually anywhere, and under variable circumstances. Additionally, the numerous ways in which the racing game 2 can be played allow for children and adults of all ages to enjoy the racing game 2 and tailor it to a specific age group at any given time. The racing game 2 also allows for any number of players to participate by including individual players, teams, and leagues. Furthermore, each game can be tailored to last a desired length of time.

While certain representative embodiments and details have been shown for purposes of illustrating the invention, it will be apparent to those skilled in the art that various changes may be made without departing from the scope of the disclosure, which is further described in the following appended claims.

What is claimed is:

1. A method for playing a racing game, the method comprising the steps of:

a) establishing a gaming apparatus having a plurality of physical and cooperating game components, the gaming apparatus including i) a game surface having a race track with markings defining a start line, a finish line, and lanes, the lanes separated into discrete spaces by additional markings oriented transverse to the markings defining the lanes, each of the lanes having a lane number associated therewith, and each of the lanes defining a complete circuit on the game surface, ii) a plurality of game pieces representing a plurality of players, each of the game pieces capable of advancing one or more of the discrete spaces on the race track around one of the lanes, and each of the game pieces having a size configured to fit entirely within each of the discrete spaces of the lanes, the game pieces cooperating with the game surface when the game pieces are disposed within the discrete spaces of the lanes and abutting the game surface, and iii) at least two random number generators configured to each generate the lane numbers associated with the lanes;

b) determining a lane choice for each of the players by generating the lane number using only a single one of the random number generators, the lane choice being the same as the lane number generated, wherein the step of determining the lane choice for each of the players includes permitting each of the players, in turn, to use the single one of the random number generators, wherein the lane choice is determined for a player having the turn if the lane number generated is different from any lane number previously generated, wherein the lane choice is not determined for the player having the turn if the lane number generated is the same as any lane number previously generated, and the player having the turn that generated the lane number the same as any lane number previously generated is only permitted to again use the single one of the random number generators when all of the players have also had turns to use the single one of the random number generators, and wherein the use of the single one of the random number generators by each of the players continues in turn until the lane choices are determined for all of the players;

c) subsequent to the step b), placing the game pieces of the players in the discrete spaces of the lanes at the start line, the placement of the game pieces controlled by the lane choice determined for each of the players in step b), the placing of the game pieces of the players in the lanes of the game surface at the start line defining a first state of the gaming apparatus with the game pieces each disposed in the lanes and abutting the game surface in a first spatial relationship relative to each other;

d) subsequent to the step c), each of the players generating in turn at least two of the lane numbers using the at least two random number generators, wherein the player with the game piece in the lane having a first lane number has a first turn at using the at least two random number generators; and e) advancing the game pieces around the lanes of the race track, wherein one of the game pieces is advanced at least one of the discrete spaces within the lane of the one of the game pieces when the lane number associated with the lane in which the one of the game pieces was placed is generated by at least one of the at least two random number generators in step d), and wherein the advancing of the game pieces around the race track within the lanes transforms the gaming apparatus from the first state to at least one second state with at least one second spatial relationship of the game pieces relative to each other that is different from the first spatial relationship, the game pieces in the at least one second state also disposed in the lanes and abutting the game surface; and f) permitting the players to repeat steps d) and e) until at least one of the game pieces completes a predetermined number of laps around the race track and crosses the finish line.

2. The method of claim 1, wherein the game surface is one of a floor mat, a table cloth, a place mat, a magnetic white board, a yard, and a board.

3. The method of claim 1, wherein the game pieces include a toy car.

4. The method of claim 1, wherein the at least two random number generators are dice.

5. The method of claim 1, wherein the game pieces are advanced more than two spaces in step e) if the lane number is generated twice at the same time by the at least two random number generators in step d).

* * * * *